United States Patent [19]

McTaggart

[11] Patent Number: 4,908,868

[45] Date of Patent: Mar. 13, 1990

[54] PHASE POLARITY TEST INSTRUMENT AND METHOD

[76] Inventor: James E. McTaggart, 21470 Rambla Vista, Malibu, Calif. 90265

[21] Appl. No.: 312,447

[22] Filed: Feb. 21, 1989

[51] Int. Cl.[4] ..... H04H 5/00

[52] U.S. Cl. ..... 381/59; 307/358; 328/133; 381/12

[58] Field of Search ..... 381/1, 12, 97, 59, 96; 340/658; 307/355, 358, 514, 516; 328/133; 324/83 A

[56] References Cited

U.S. PATENT DOCUMENTS

| | | | |
|---|---|---|---|
| 3,067,297 | 12/1962 | Fink | 381/1 |
| 3,148,287 | 9/1964 | Bauer et al. | 381/1 |
| 3,206,550 | 9/1965 | Fink | 381/12 |
| 3,548,321 | 12/1970 | Duquesne | 328/133 |
| 3,840,817 | 10/1974 | Seki | 307/514 |
| 4,648,113 | 3/1987 | Horn et al. | 381/1 |
| 4,691,358 | 9/1987 | Bradford | 381/12 |

*Primary Examiner*—Forester W. Isen
*Attorney, Agent, or Firm*—J. E. McTaggart

[57] ABSTRACT

The relative phase polarity between two acoustic or electric signals is determined easily, quickly and conclusively with a hand-held instrument providing immediate visual polarity indication. Built-in dual-channel amplification enables a pair of microphones to be utilized as acoustic probes, of particular versatility and benefit in the audio sound field, enabling extremely efficient and virtually fool-proof verification of relative phase polarity between two loudspeakers in practically any sound system or environment during normal operation from almost any source, monophonic, stereophonic, music, speech or even noise, without any dismantling, trial-and-error experimentation, subjective guesswork or other uncertainties usually associated with speaker phasing. An OR-function detector selects the stronger of the two signals under test for comparison with a sum signal derived in an instantaneous summing circuit. In one embodiment, a pair of LED indicators, "IN-PHASE" (green), and "OUT-OF-PHASE" (red), are driven from a dual-comparitor discriminator circuit. A second pair of LEDs may be provided to check signal presence in each channel. In another embodiment, of extended utility as a combined stereo audio/sound field strength dB meter/monitor and phase polarity analyzer/monitor, three multi-element LED displays, of the logarithmic dot/bar graph type, monitor the dynamic levels of the left channel, sum and right channel, arranged in a side-by-side array for visual comparison. Potential uses include testing of speakers, microphones, amplifiers and the like. Among possible options, input potentiometers may be provided in each channel for gain control and balancing, shielded probes may be used for electrical point-to-point in-circuit testing, and the capabilities may be expanded to frequency-selective testing by utilizing a signal generator source.

19 Claims, 3 Drawing Sheets

PHASE POLARITY TEST INSTRUMENT AND METHOD

FIELD OF THE INVENTION

This invention, in the general fields of electronic technology, physics and acoustics, relates to electronic circuitry and related methods for determining the relative phase polarity between a related pair of acoustic or electrical signals, and more particularly, in the fields of audio and sound reproduction, to an easily operated electronic instrument for readily and conclusively determining the relative phase polarity between sound signals emanating from a pair of loudspeakers.

BACKGROUND OF THE INVENTION

The practice of audio technology is characterized by ever increasing use of multiple amplifiers and multiple loudspeakers, either in a monophonic mode where one or more primary sources such as microphones feed a single channel, or in the increasingly prevalent stereophonic mode employing two or more channels. In either mode it is increasingly common to feed multiple amplifiers from each channel and to feed multiple speakers from each amplifier, as found in a large variety of audio equipment such as stereo home music systems, automobile stereo systems which may utilize four or more amplifiers driving four or more speakers, multi-amplifier multi-speaker sound reinforcement systems for musical performance, auditorium sound systems and the like.

It is well known that multiple speakers in a system should always be operated in phase with each other for best results, and that otherwise, operating one (or more) speaker out of phase with the other(s) degrades both the efficiency and the fidelity of sound performance, particularly at low frequencies, due to cancellation effects. Correct speaker phasing is clearly important in multi-speaker monophonic systems, and is equally important in stereo systems: even though stereo systems are made capable of a high degree of interchannel isolation, in practice high degrees of program material separation are relatively infrequent overall since it has become customary in the artistic judgments of originatin and mixing stereo sound material to direct substantial portions of the audio source content to both channels in common, particularly at low frequencies where limited power-handling capabilities in reproduction are an important consideration. Thus the importance of correct speaker phasing in monophonic systems applies equally to stereo systems, and has become even further emphasized by the close identification of "stereo" with "high fidelity".

In audio practice involving such audio systems the need frequently arises to quickly and conclusively determine whether all of the amplifiers and speakers in a multi-speaker system are connected with correct polarity so that the speakers operate in phase with each other.

In new packaged audio equipment having internal speakers it is often assumed that, as originally furnished, the speakers would be properly connected in phase. However, where consumers hook up separate speakers, and even in packaged units which have been serviced or otherwise modified, there are many possibilities for unintentional loss of correct speaker phasing. The original phasing may have been reversed in the process of repairing or replacing speakers, speaker wiring, and/or amplifiers. In recognition of potential polarity errors, reputable manufacturers often provide polarity code markings on speaker terminals, and sometimes on amplifier output terminals; however such markings, while playing a useful role in polarity maintenance, are frequently misundestood or ignored, and in many instances are not readily accessable, being concealed within an enclosure.

DESCRIPTION OF PRIOR ART

With regard to testing methods for determining relative phase polarity of speakers in a completed audio system, the simplest method is a simple aural listening test, perhaps with the listener moving about to different locations in front of the speakers while they operate from a common source, and attempting to judge by ear whether they are operating in phase with each other. Such a test is highly subjective: even though it may be possible for a highly experienced sound expert in a familiar and ideal controlled acoustic environment such as a recording studio to aurally discern phase reversal error with some degree of reliability, generally this type of simple listening test tends to be highly erratic and inconclusive under typical field conditions where the acoustic environment is non-ideal and the listener unfamiliar or non-expert.

A comparative aural phase testing method, which may provide more conclusive results than a non-comparative aural test, has been used occasionally in known art: in a group of two or more speakers, one of these to be tested for phase polarity is temporarily connected through a polarity-reversal switch operable by the listener and, with the speakers operating from a common source, the speaker under test is alternately switched between each of the two possible polarity connections while the listener attempts to aurally discern the difference and choose the better sounding of the two modes as the correcct polarity. This type of test is not often practiced due to the numerous disadvantages such as the inconvenience of having to provide a suitable switch and having to gain access and disturb the speaker wiring to temporarily install the switch, making the switch listener-operable from various listening locations, the dependency on the experience and subjective judgment of a human operator, and finally the possibility of confusion and error in restoring the final connections compouned by inability to conclusively verify that the phasing polarity has indeed been corrected in the completed assembly.

In summary, all aural type phase polarity tests are highly subjective, depending heavily on the acuity and experience of the listener as well as the quality of the acoustic environment, and thus such tests generally tend to be questionable, inconclusive and unsatisfactory, even where only two speakers are involved. These difficulties become compounded when more than two speakers are involved.

A well-known technique for checking speaker polarity is to connect a battery to the speaker terminals, observing the direction of cone displacement; this often necessitates grill cloth removal. Yet testing the speaker alone may not be sufficient; all speaker wiring and both input and output connections to all amplifiers, as well as sources such as microphones, tape players, record players, tuners and so forth in a system must be questioned with regard to overall polarity, and further uncertainties arise with non-identical multiple amplifiers.

In recognition of the importance of correct phase polarity in stereophonic systems, Donald G. Fink addressed the associated measurement difficulties in his disclosure of APPARATUS FOR DETERMINING THE POLARITY OF STEREOPHONIC CHANNEL CONNECTIONS AT ANY SELECTED POINT in U.S. Pat. No. 3,067,297. Fink drives the input of the system under test, locally or remotely, by a specially generated test signal having an asymmetrical pulse waveform, so as to provide a polarity indication discernible to a technician monitoring the signals at a selected point, utilizing an oscilloscope or a special asymmetry-responsive metering circuit, switched sequentially between channels, thus enabling the absolute phase polarity of each channel, and thus their relative phase polarity, to be determined. Although the Fink patent, at column 1, line 37, recognizes the need for proper speaker polarity, it discloses and claims only apparatus for determining polarities of electrical signals measured at a desired point, and does not address testing the acoustic output of speakers. The Fink patent, directed primarily to preliminary or down-time checkout of wired broadcasting facilities, requires that the two channels be driven from a special pulse generator, and therefore cannot be practiced on broadcast equipment during regular broadcasting activity, and in any case cannot be practiced using ordinarily available audio source material.

Well-known conventional test bench and laboratory techniques for measuring phase angle include stimulating the system from an audio signal generator and observing test points with a triggered oscilloscope having a calibrated X-axis sweep, or with a synchronized vectorscope, which is a highly specialized phase-measuring instrument providing a polar phase display on a CRT, such as was described in U.S. Pat. No. 4,648,113 to Horn, assigned to Tektronix, Inc., for METHOD AND APPARATUS FOR PROVIDING A VISUAL INDICATION OF A RELATIONSHIP BETWEEN TWO SIGNALS. Such techniques represent "overkill" with regard to the problems addressed herein, since it is desired to avoid bulky and complex-to-use equipment and since it is not required to make a precise measurement of the phase angle, or even to determine absolute polarity relative to a reference as taught in the Fink patent: all that is sought in the context of the present invention is to conclusively determine the relative polarity between two signals, that is whether one signal is substantially in phase (0 degrees phase angle) or substantially out of phase (180 degree phase angle) with respect to the other, with no particular regard to precise phase angle accuracy within a broad working range. Practically all signals encountered would fall within such a range since an "out-of-phase" condition is the result of a definite 180 degree inversion, such as would be introduced by using an amplifier having an odd number of inverting stages, or by transposing the connections at a pair of terminals, such as speaker, amplifier output or audio transformer terminals. Within the audio frequency range, incidental phase angle errors such as shifts and imbalances introduced by differences in the length of wired or acoustic paths in the two channels are negligibly small, and are readily distinguishable from a 180 degree polarity reversal error.

A technically adequate acoustic test could be practiced by those of skill, utilizing an assemblly of known audio equipment as follows: a matched pair of microphones, one placed in front of each speaker, could be amplified by balanced microphone preamplifiers connected to balanced X- and Y-axis inputs of an XY oscilloscope, on which Lissajous figures could be displayed and analyzed. This measurement, operated by a skilled technician, could potentially provide capability of phase polarity determination utilizing various audio sources; however, such practice would require considerable expertise in the interconnection and operation of several pieces of bulky equipment, and thus it would fail to provide the convenience and simplicity required to make it useful as an every-day tool in the field of audio and sound.

Thus known art for determining phase polarity ha failed to solve numerous problem and meet several long-standing and increasing needs in this field.

SUMMARY OF THE INVENTION

The present invention addresses heretofore unfulfilled needs for improved methods and associated convenient, compact test instrumentation, capable of non-subjectively and umambiguously determining and indicating the relative phase polarity between two signals, and in particular, between the acoustic outputs of a pair of speakers carrying normal audio program material, using simplified test methods suited to field use by relatively non-technical and unskilled personnel.

It is a primary object of this invention to provide an improved method and corresponding novel instrumentation for detecting and visually indicating the relative phase polarity between two electrical audio signals.

It is a further priary object of this invention to introduce positive methods including visual means for indicating relative phase polarity between two acoustic sources, in elimination of the variations and uncertainties associated with subjective aural methods.

It is a further object to introduce the utilization of such instrumentation in combination with a matched pair of microphones to provide the capability of monitoring the acoustic output from each of two loudspeakers, performing under actual operating conditions receiving audio program material from a common source such as a radio broadcast, recorded media or the like, so as to determine and visually indicate the relative phase polarity between the two acoustic outputs.

It is a further object of this invention to provide an audio phase polarity tester for field use in a compact, hand-held battery-operated configuration which is much more compact, convenient and conclusive than has been provided in instruments and methods which have been known and used heretofore for this purpose.

The objects of the invention have been met in embodiments utilizing electronic audio processing circuitry which may be summarized as having two basic functional elements: (a) a linear electronic summation of the instantaneous waveforms of the two audio signals under test, typically after amplification, to provide a "sum" signal, and (b) means for visually indicating relative phase polarity between the two audio signals, based on a comparison of the amplitude relationship between the "sum" signal and at least a selected one of the two audio signals.

The detailed implementation and operation of the invention will be best understood by study of the drawings and following description.

DETAILED DESCRIPTION

Figure 1:
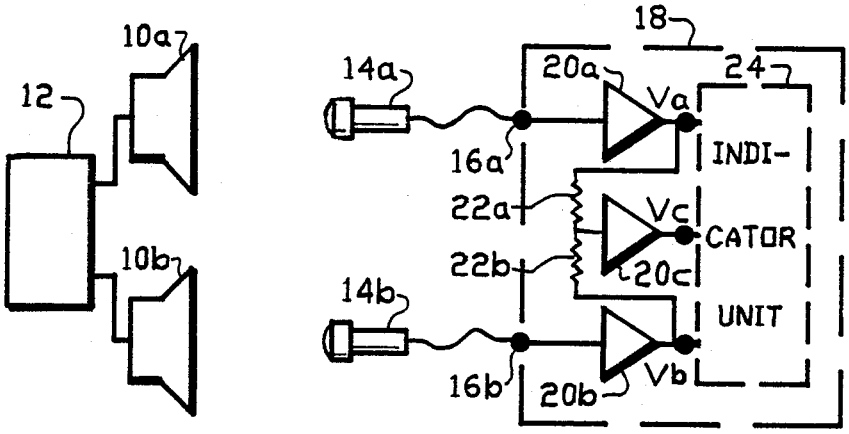
FIG. 1 is a functional block diagram showing the basic elements of a phase polarity test instrument as utilized in testing an audio system having two loudspeakers, in accordance with this invention.

FIG. 1 is a functional block diagram of the basic elements of this invention as practiced in a typical test arrangement for determining relative phase polarity between two acoustic signals, one emanating from a first speaker 10*a* and the other from a second speaker 10*b*, these being audio loudspeakers of known type, driven from a common audio source 12 such as a phonograph, taper recorder, radio receiver or the like. The driving signals applied to the speakers 10*a* and 10*b* may be monophonic, i.e. identical to each other, or stereophonic, assuming a substantial coherent component common to both channels. Two microphones 14*a* and 14*b*, located within primary acoustic fields of speakers 10*a* and 10*b* respectively, provide a pair of input signals to input terminals 16*a* and 16*b* of a novel phase polarity indicating instrument 18 which includes three audio amplifiers: amplifier 20*a*, receiving input from microphone 14*a*, amplifier 20*b* receiving input from microphone 14*a*, and amplifier 14*c*, receiving input from the common junction of a pair of identical resistors 22*a* and 22*b* which are connected to the outputs of amplifiers 20*a* and 20*b* respectively. Amplifiers 20*a*, 20*b* and 20*c* serve as buffering circuits to deliver three signals at low output impedance: buffered signals Va and Vb, and sum signal Vc respectively. These are supplied as input to an indicator unit 24 which comprises electronic circuitry including means for visually indicating relative phase polarity.

Amplifiers 20*a* and 20*b* are made have equal gain, sufficient to amplify typical signals from microphones 14*a* and 14*b* to a working value, typically in the order of a few volts peak-to-peak. Resistors 22*a* and 22*b* are made equal in resistance value, typically 120k ohms, the value being very large relative to the low output impedance, typically well below 10 ohms, of amplifiers 20*a* and 20*b*, such that the input of amplifier 20*c* receives buffered signal Va, attenuated 2:1, along with buffered signal Vb, also attenuated 2:1. Amplifier 20*c* is made to have a gain of two times to compensate for the 2:1 attenuation, therefore the instantaneous amplitude of its output signal Vc will be the instantaneous algebraic sum of the instantaneous amplitudes of Va and Vb: this may be expressed Vc=Va+Vb.

It should be readily apparent that if the two input signals from microphones 14*a* and 14*b*, are identical in waveform and amplitude and are in phase with each other, the sum signal Vc, being Va+Vb, will have an amplitude twice that of buffered signals Va and Vb; but if the input signals from the microphones are 180 degrees out of phase with each other, Va and Vb will cancel each other when summed, thus Vc will be zero. Thus the phase polarity is readily distinguishable by comparing the amplitude of sum signal Vc with that of the buffered signals Va and Vb.

Even if the two buffered signals Va and Vb are unequal in amplitude and/or less than fully coherent (not exactly the same waveform, such as in typical stereo program material), their relative phase polarity can be determined by comparing the amplitude of sum signal Vc with that of the two buffered signals Va and Vb, or, if they are unequal, with that of the major signal, i.e. the larger of the two buffered signals: an "in phase" condition is indicated by the sum signal Vc being greater in amplitude than the major signal (but somewhat less than double), while and "out-of-phase" condition is indicated by the sum signal Vc being smaller in amplitude than the major signal (but greater than zero). If Va and Vb are completely incoherent, (for example totally unrelated stereo) the sum signal Vc will tend to equal the major signal in amplitude; the same would apply to a 90 degree phase difference. If only one input signal is present (Va or Vb=0) then Vc would simply duplicate whichever signal is present, Va or Vb, at equal amplitude. The function of indicator unit 24 is to provide a visual "in-phase" or "out-of-phase" indication depending on the amplitude of Vc relative to that of Va and/or Vb as described above.

Figure 2:
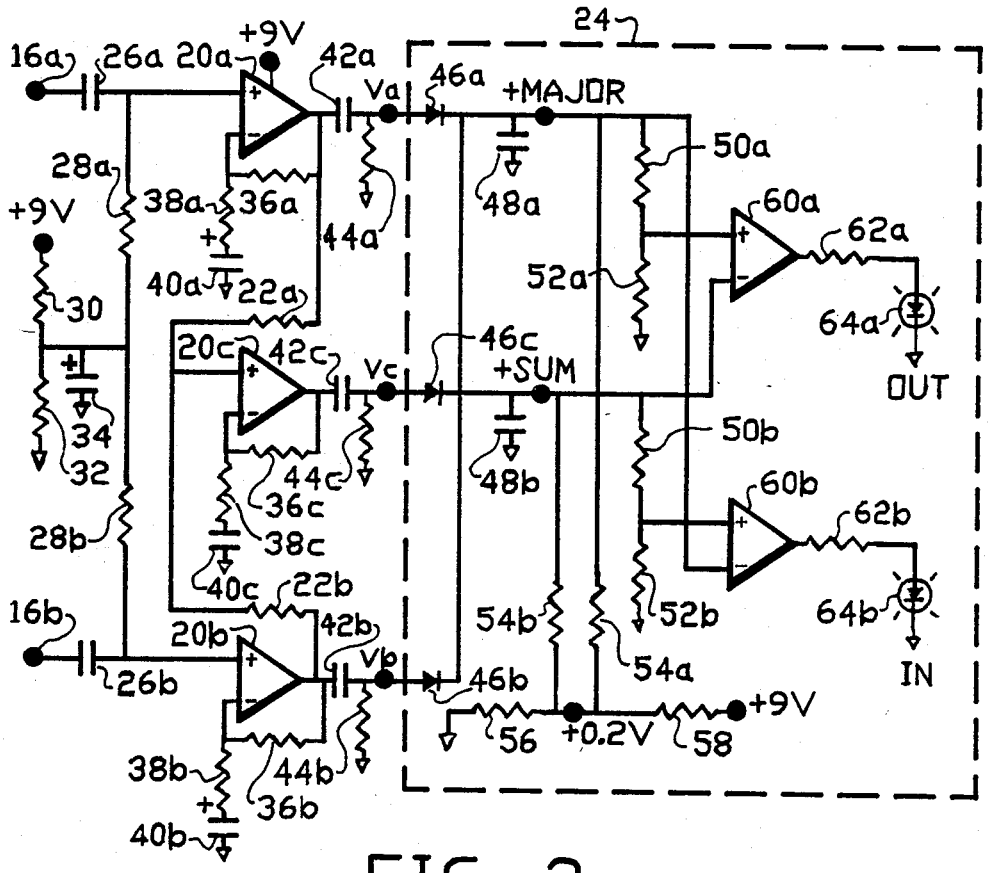
FIG. 2 is a detailed schematic diagram of electronic circuitry of a phase polarity test instrument, in accordance with basic principles of this invention as shown in FIG. 1, in an embodiment which provides visual indication of relative phase polarity by means of a pair of light emitting diodes.

FIG. 2 is a detailed schematic diagram of electronic circuitry within a first embodiment of a phase polarity indicating instrument (18 in FIG. 1) which provides polarity indication in the form of a pair of LEDs (light emitting diodes), one to indicate "in-phase" polarity and the other to indicate "out-of-phase" polarity. Input terminals 16*a* and 16*b* are connected through coupling capacitorss 26*a* and 26*b* respectively to non-inverting (+) inputs of amplifiers 20*a* and 20*b* which are designed around well known opamps (operational amplifiers) realized as IC (integrated circuit) chips in conventional dual in-line packaging.

Resistors 28*a* and 28*b* bias the non-inverting inputs at approximately +4.5 volts from voltage divider formed by resistor 30, connected to a +9 V supply bus and resistor 32 connected to a common ground bus, their junction being bypassed by capacitor 34. The amplifier voltage gain provided by opamps 20*a* and 20*b* is determined by the resistance values in the negative feedback circuits: resistors 36*a*, 38*a*, 36*b* and 38*b*; typically the gain is set at 60 dB for use with crystal ceramic type microphones. The gain of opamp 20*c* is set to two times by making resistors 36*c* and 38*c* equal in value. Capacitors 40*a*, 40*b* and 40*c* provide strong negative feedback bias point stabilization and set the low end cutoff frequency of the audio range, typically around 90 Hz.

Resistors 22*a* and 22*b* as described above in connection with FIG. 1 are made equal in value to merge the two buffered signals from the outputs of amplifiers 20*a* and 20*b*, this merged signal being applied to the + input of amplifier 20*c*.

The three output signals from amplifiers 20a, 20b and 20c are coupled through capacitors 42a, 42b, and 42c to grounded load resistors 44a, 44b and 44c so as to provide three ground-referenced signals (buffered signals Va and Vb and sum signal Vc) which are applied to the anodes of diodes 46a, 46b and 46c. The catodes of diodes 46a and 46b are connected together to share in common the "major" detector load circuit comprising capacitor 48a and resistors 50a and 52a, forming a dual-input OR-function quasi-peak envelope detector in which only the larger of the two signals Va or Vb will be detected as a rectified d.c. "+major" voltage. Resistors 50a and 52a form a "major" voltage divider having an attenuation factor K, i.e. the ratio R52a/(R52a+R-50a). Connected to the cathode of diode 46c, the "sum" detector load circuit comprising capacitor 48b and resistors 50b and 52b, is nominally identical with the "major" detector load ciruit. The detector loads are cross-coupled to the comparitors as shown: comparitor 60a, controlling "out-of-phase" LED indicator 64a through resistor 62a receives a divided-down portion of the "+major" voltage at its+input and the full "+sum" voltage at its−input, while comparitor 60b, controlling "in-phase" LED indicator 64b, receives a divided-down portion of the "+sum" voltage at its+input and the full "+major" voltage at its−input. A small positive bias voltage is applied to each detector load through resistors 54a and 54b which are each connected to a low DC voltage, typically +0.2 volts, divided down from +9 V by resistors 56 and 58.

In operation of the circuit of FIG. 2, when no input signals are present the positive bias applied through resistors 50a and 50b causes a voltage drop in the order of 0.01 volts across each resistor 50a and 50b, acting as a holdoff bias which reverse-biases comparitors 60a and 60b to their "offF" state, their "low" outputs thus holding LEDs 64a and 64b unenergized.

When a signal is applied to only one of the two input channels, then, as described in connection with FIG. 1, sum signal Vc will be equal in amplitude to the major signal, Va or Vb, whichever one is present; thus the "+major" and "+sum" voltages will increase but remain equal, and the voltage drop across resistors 50a and 50b will also increase equally, continuing to hold comparitors 60a and 60b "off" with LEDs 64a and 64b remaining unenergized.

When signals of sufficient working level are present in both input channels, then the detected "+major" voltage developed at capacitor 48a approximates the peak amplitude of the major signal, and the detected "+sum" voltage develped at capacitor 48b approximates the peak amplitude of sum signal Vc (which is the instantaneous algebraic sum, Va+Vb). If the two input signals are in phase, the amplitude of sum signal Vc will be greater than that of either buffered signals Va or Vb; consequently the "+sum" voltage will exceed the "+major" voltage sufficiently to unbalance the comparitor inputs so that the divided "+sum" voltage at the+input of comparitor 60b exceeds the "+major" voltage at its−input, thus biasing comparator 60b to its "on" state whereby its high output energizes LED 64b to indicate an "in-phase" polarity condition. At the same time, LED 64a is held unenergized since comparitor 60a remains biased "off" by the "+sum" voltage at its−input greatly exceeding the divided "+major" at its+input.

Conversely, when the input signals are out of phase with each other, the "+major" voltage exceeds the "+sum" voltage sufficiently to unbalance the comparitors 60a and 60b in the opposite direction so that comparitor 60a becomes biased "on", energizing LED 64a to indicate an "out-of-phase" polarity condition, while comparitor 60b becomes biased "off", holding LED 64b unenergized.

Figure 3:
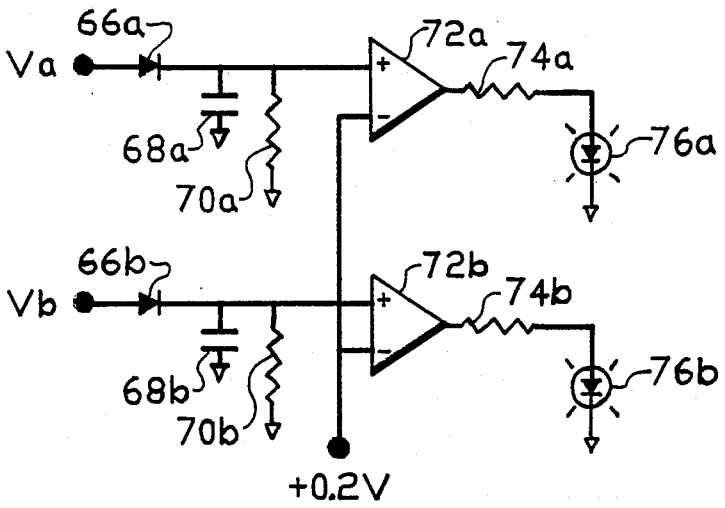
FIG. 3 is a schematic diagram of input signal indicator circuitry which may be incorporated additionally into the embodiment of this invention shown in FIG. 2 as a preferred but non-essential option.

FIG. 3 is a schematic diagram of optional circuitry which may be incorporated as an addition to the circuitry of FIG. 2 to provide LED indication of the presence of signals of sufficient working level in each input channel, as a diagnostic aid in using the phase polarity test apparatus of this invention. Buffered signal VA (at resistor 44a in FIG. 2) is applied to the anode of diode 66a, the cathode of which is connected to the ground-returned detector load comprising capacitor 68a and resistor 70a in parallel. The detected voltage is applied to the+input of opamp comparitor 72a, the−input being connected to a threshold reference source of +0.2 volts d.c. (at the junction of resistors 56 and 58 in FIG. 2). The output of comparitor 72a is connected through resistor 74a in series with LED 76a to ground.

A second circuit, nominally identical with that described, comprising elements 66b–74b, receives buffered signal Vb (at resistor 44b in FIG. 1) as input at the anode of diode 66b. Each circuit acts as a simple detector and level threshold switch, for example, when Va=0, i.e. no signal reaching diode 66a, comparitor 72a, having 0 volts at its+input and+0.2 volts at its−input, will remain in its "off" state, its output low and LED 76a unenergized.

When a buffered signal Va is present, if its peak amplitude exceeds a threshold value of approximately 0.7 volts, then assuming 0.5 volts forward diode drop, the positive voltage developed at the deetector load will exceed the +0.2 volt comparitor reference, causing comparitor 72a to transition to its "on" state, its high output energizing LED 76a. Such action in each half of the circuit thus provides independent visual indication in each input channel for verifying presence of signal having amplitude above the predetermined level.

Figure 4:
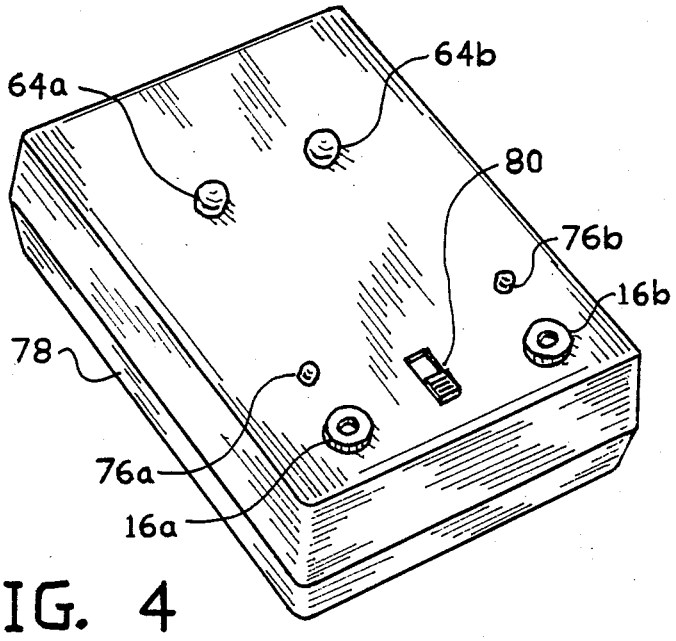
FIG. 4 is a perspective view of a phase polarity test instrument of this invention, in an embodiment incorporating the elements of FIG. 2 and FIG. 3, based on FIG. 1.

FIG. 4 is a perspective view of a phase polarity test instrument in accordance with this invention, packaged in a hand-held style case 78, in an embodiment which incorporates circuitry such as that shown in FIG. 2 and FIG. 3. LED 60a, the "out-of-phase" indicator and LED 60b, the "in-phase" indicator (refer to FIG. 2) are of different color, typically red and green respectively, for easy distinction. Input signal level indicators, LEDs 76a and 76b are located near corresponding input terminals 16a and 16b (refer to FIG. 1 and FIG. 2); these input terminals may be well known miniature phone jacks, commonly used as microphone jacks. Contained within the case 78 is a common 9 volt dry cell battery connected through on-off switch 80 to provide the internal power source at the supply bus designated "+9 volts" in FIG. 2.

The instrument is operated in the manner described in connection with FIG. 1: microphone 14a is placed near speaker 10a and microphone 14b is placed near speaker 10b, and the speakers are driven from common source 12 of audio signal or program material which may monophonic or quasi-coherent stereo. Presence of viable input signals in each channel will be indicated by energization of LEDs 16a and 16b, and the relative phase polarity between the sound output of the two channels will be clearly indicated by energization of either LED 64a or 64b.

The inclusion of LEDs 76a and 76b and associated circuitry of FIG. 3 in the embodiment of FIG. 4, is an option which serves solely to provide the auxiliary convenience of input signal verification, and is not at all essential to the basic functioning and operation of the instrument in accordance with this invention. Therefore the invention may be practiced without the circuitry of FIG. 3, in a basic embodiment utilizing only the circuitry shown in FIG. 2 or its equivalent. The appearance would remain as shown in FIG. 4 except for the omission of LEDs 76a and 76b.

Figure 5:
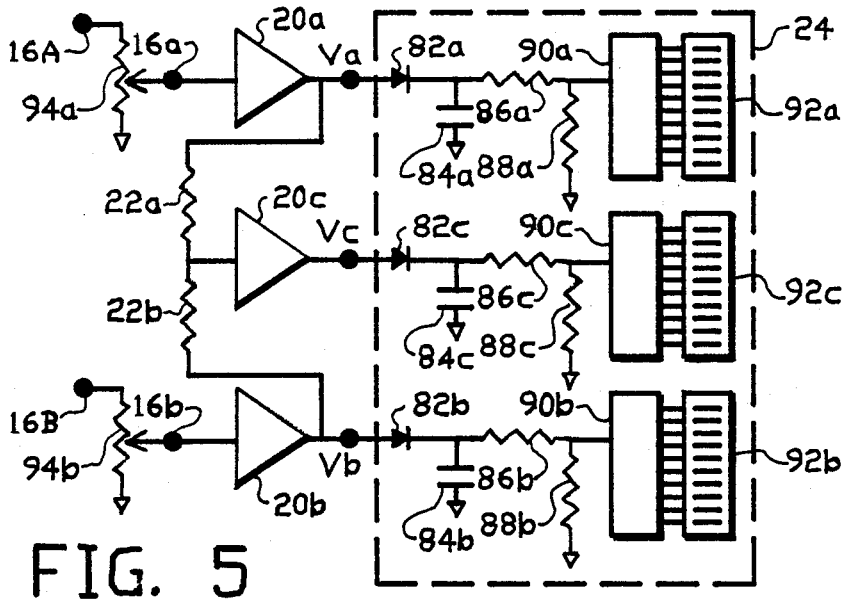
FIG. 5 is a detailed schematic diagram of electronic circuitry of a phase polarity test instrument, in accordance with the basic principles of this invention as shown in FIG. 1 in an embodiment which provides visual indication of relative phase polarity by means of a set of three LED dot/bar graph type output level indicators.

FIG. 5 shows an alternative embodiment, wherein the indicator unit 24 (FIG. 1) is realized in the form of three identical independent signal detector/amplitude level metering circuits enabling the user to continuously monitor the levels of signals Va, Vb and Vc simultaneously, and consequently determine relative phase polarity by observing the relationship between the three levels observed. Amplifiers 20a, 20b and 20c, along with summing resistors 22a and 22b of FIG. 5 are typically identical with the configurations shown in FIG. 2 (and FIG. 1).

Signals Va, Vb and Vc are each processed identically as in the following example. Diode 82a develops a rectified positive dc voltage across load capacitor 84a in parallel with a resistive detector load comprising resistors 86a and 88a in series, forming a voltage divider. The voltage at the junction of resistors 86a and 88a is applied as input to display driver circuit 90a which drives a plurality of segments in level indicator display device 92a which is of the well known LED dot/bar graph type and which is thus enabled to act in the manner of well known audio level metering devices (VU meters) to indicate the level of the audio signal, typically in logarithmic steps such as 10 steps of 3 dB per step. The LED display devices 92a, 92b and 92c and their associated driver circuits 90a, 90b and 90c are available commercially in dual in-line IC packaging. Type LM3915N driver devices provide a choice between a dot graph display or a bar graph display by connecting pin 9 to pin 3 or 11 respectively; the dot graph display mode was chosen for use in this invention in consideration of its lower battery current drain. Full information on such display drivers is provided by National Semiconductor Co.

Potentiometers 94a and 94b are provided as gain controls, connected as shown at input terminals 16a and 16b, the two channel signals under test (from microphones or other sources) being applied at input terminals 16A and 16B.

Figure 6:
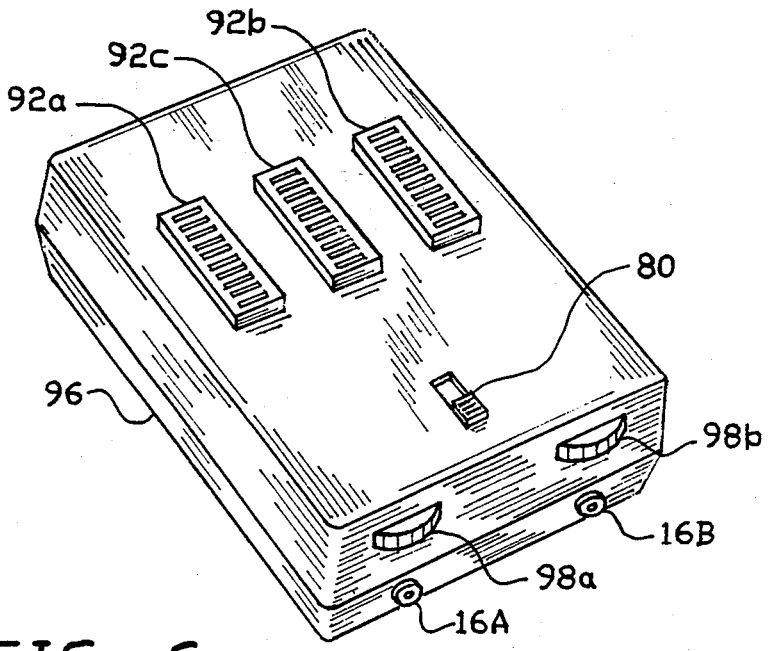
FIG. 6 is a perspective view of a phase polarity test instrument of this invention, in an embodiment which incorporates the elements FIG. 5, based on FIG. 1.

FIG. 6 is a perspective view of a phase polarity test instrument in accordance with this invention, packaged in a hand-held style case 96, in an embodiment which incorporates circuitry and display devices such as in FIG. 5. The three LED level display devices are disposed in a side-by-side array in the sequence shown: 92a, 92c, 92b. Knobs 98a and 98b, providing gain adjustment, are attached to internally mounted potentiometers (94a and 94b of FIG. 5, respectively), and located to correspond with input terminals 16A and 16B which are miniature phono jacks, suitable for receiving mating plugs of microphones or test cables. Circuitry implemented in well known printed circuit form is contained internally, including the circuitry of FIG. 5 wherein the circuitry pertaining to amplifiers 20a, 20b and 20c, shown simplified, may be as shown and described in detail in connection with FIG. 2. All supply voltage points indicated +9 volts are powered from a popular type 9 volt dry cell battery through an "on-off" switch 80.

In operation, with input signals applied at jacks 16A and 16B, the gain control knobs 98a and 98b are adjusted to obtain approximately equal level indications on displays 92a and 92b. Then the sum signal level indicated on display 92c is observed and compared with the buffered signal levels indicated on displays 92a and 92b: a sum level higher than both the buffered signal levels signifies an "in-phase" condition between the input signals, and conversely a sum level lower than the major buffered signal level signifies an "out-of-phase" condition. Even in the presence of speech or music of varying level, since the fluctuations observed in all three level indicators tend to track together, the adjacent positioning of the three displays as shown in FIG. 6 enables easy and unambiguous determination of phase polarity from visual comparison of the three level indications.

In a variation of the embodiment of FIG. 6, the instrument shown may be augmented by the inclusion of a pair of LEDs corresponding to 64a and 64b of FIG. 2, along with the associated circuitry contained within indicator unit 24 as indicated by the dashed outline in FIG. 2. The anodes of diodes 46a, 46b and 46c (FIG. 2) would be connected to the anodes of diodes 82a, 82b and 82c (FIG. 5) respectively. LEDs 64a and 64b could be located above the thre three LED displays 92a, 92b and 92c in FIG. 6, in the approximate locations shown in FIG. 4, and would provide further visual indication of relative phase polarity in confirmation of indication provided by the three LED displays 92a, 92b and 92c as previously described.

In the foregoing descriptions in connection with FIGS. 1–6 the following component values are known to enable the invention to be made and practiced as described:

| | |
|---|---|
| Opamps | 20a, 20b, 20c, 60a, 60c: LM324N (quad) or LM358 (dual) |
| Diodes | 46a, 46b, 46c, 66a, 66b: 1N916 |
| Capacitors, working voltage 10 volts or higher: | |
| | 26a, 26b: 0.047 μF |
| | 34, 40a, 40b: 4.7 μF |
| | 40c, 42a, 42b, 42c, 48a, 48b: 0.47 μF |
| | 68a, 68b: 0.01 μF |
| | 84a, 84b, 84c: 0.1 μF |
| Resistors, ¼ watt unless indicated otherwise: | |
| | 22a, 22b: 120 k |
| | 28a, 28b, 36a, 36b: 330 k |
| | 30, 32: 4.7 k |
| | 38a, 38b: 330 |
| | 36c, 38c, 44a, 44b, 44c, 58: 47 k |
| | 52a, 52b: 330 k |
| | 50a, 50b: 68 k |
| | 54a, 54b, 70a, 70b: 1 megohm |
| | 56: 1 k |
| | 62a, 62b, 74a, 74b: 680 ½ watt |
| | 70a, 70b: 470 k |
| Potentiometers 94a, 94b: 500 k linear taper | |
| Dot/bar graph display driver: 90a, 90b, 90c: LM3915N 3 dB/step | |
| LED dot/bar graph display: 92a, 92b, 92c: MV50164 10 segment | |

Any of the embodiments shown and suggested may be readily adapted for operation from the ac power line by utilizing a well-known wall outlet type 110 volt ac to 9 volt dc adaptor.

In other variations of the basic embodiments, different combinations of the elements disclosed could enable the useful practice of this invention and enjoyment of its benefits: for example, the circuitry of FIG. 2 could be augmented by the addition of a pair of LED displays such as 92*a* and 92*b* and associated circuitry as shown in FIG. 5 (but not including display 92*c* and associated circuitry), so as to provide the advantages of LED dot/bar graph indication of signal levels in the two input channels, as an alternative to the single LED signal indicators 76*a* and 76*b* of FIG. 4, while relying on LEDs 64*a* and 64*b* for phase polarity indication.

The inclusion of some form of audio level meter such as LED dot/bar graph display 92*a* in each channel provides the user with helpful diagnostic information such as the relative amplitudes of the two audio signals and an indication of the degree of coherence between the two channels, based on how closely they track each other in amplitude, and aids the user in interpreting results and exercising judgment in cases where results may be marginal due to grossly non-ideal signal or acoustic conditions.

In any of the embodiments, input potentiometers such as 94*a* and 94*b* as shown in FIG. 5 may be provided as an option, subject to a designer's discretion and desire. They provide a convenient adjustment capability for compensating any unavoidable input unbalance and setting up equal test signals as an optimal test condition; however, since the instrument embodiments described exhibit good tolerance in the face of substantial signal unbalance, and since it is normally easy to obtain sufficient input balance, for example by adjusting the level of power applied to the two speakers under test, input potentiometers are not essential to the practice of the invention.

Any of the embodiments of this invention may be easily adapted to operate in a direct electrical (non-acoustic) testing mode by utilizing, in place of microphones 14*a* and 14*b* (FIG. 1), a pair of well known shielded input probes, such as oscilloscope probes, for enabling point-to-point phase polarity analysis in electronic hardware circuitry.

The microphones 14*a* and 14*b* of FIG. 1 may be of crystal ceramic type, and should be of the same phase polarity and reasonably matched for frequency response and gain.

With regard to the frequency response range of the amplifiers 20*a*, 20*b* and 20*c*, an audio range of approximately 90 to 1000 Hz operates satisfactorily for general purposes. It would be an obvious refinement to additionally provide user means for adjusting this range and/or switchable or otherwise adjustable filters for selection of different measurement frequency ranges or stop-bands.

There are also numerous alternative housing configurations and scenarios in which the principles of this invention may be practiced in the audio field, such as in a rack mounted configuration or otherwise adapted for such applications as continuously monitoring stereo program material in musical performance, broadcast or recording operations.

The principles and apparatus taught by this invention may be utilized beneficially in connection with other technical and scientific endeavours both within and beyond the audio field, and the invention may be embodied instill other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A phase polarity test instrument, for determining and indicating relative phase polarity between a first alternating signal and a related second alternating signal, comprising:

a first electronic buffering circuit adapted to provide, at an output thereof, a first buffered signal representing said first alternating signal;

a second electronic buffering circuit adapted to provide, at an output thereof, a second buffered signal representing said second alternating signal;

an electronic summing circuit, receiving as inputs said first and second buffered signals, and providing as output a sum signal having instantaneous amplitude equal to the algebraic sum of the instantaneous amplitudes of said first and second buffered signals; and indicating means, receiving as input said first and second buffered signals and said sum signal, adapted to provide (a) an "in-phase" indication whenever said sum signal exceeds each of said buffered signals in amplitude by a predetermined margin, and (b) an "out-of-phase" indication, distinguishable from said "in-phase" indication, whenever either of said buffered signals exceeds said sum signal in amplitude by a predetermined margin.

2. The phase polarity test instrument according to claim 1 in which said indicating means comprises:

first visual display means adapted to quantitatively indicate a first level proportional to the amplitude of said first buffered signal;

second visual display means adapted to quantitatively indicate a second level proportional to the amplitude of said second buffered signal; and third visual display means adapted to quantitatively indicate a third level proportional to the amplitude of said sum signal, whereby said "in-phase" indication is manifested by observation of said third level exceeding both said first level and said second level, and said "out-of-phase" indication is manifested by observation of either said first level or said second level exceeding said third level.

3. The phase polarity test instrument according to claim 2 wherein said first, second and third visual display means each comprise a multi-segmented display unit of the dot/bar graph LED type and an associated driving circuit, the driving circuit of the first display means having an input coupled to the first buffered signal, the driving circuit of the second display means having an input coupled to the second buffered signal, and the driving circuit of the third display means having an input coupled to the sum signal.

4. The phase polarity test instrument according to claim 3 in which said first buffering circuit and said second buffering circuit each comprise amplifier means including an associated input potentiometer.

5. The phase polarity test instrument according to claim 1 wherein said indicating means comprises:

a binary visual "in-phase" indicator;

a binary visual "out-of-phase" indicator; and comparitor means, receiving as input said first and second buffered signals and said sum signal, adapted to energize said "in-phase" indicator whenever said sum signal exceeds the greater of the first and second buffered signals in amplitude by a predetermined margin, and to energize said "out-of-phase" indicator whenever the greater of the first and second buffered signals exceeds said sum signal in amplitude by a predetermined margin.

6. The phase polarity test instrument according to claim 5 wherein said "in-phase" indicator and said "out-of-phase" indicator each comprise an LED (light-emitting diode), and said comparitor means comprises:

a first envelope detector circuit, providing a dual input OR-function, having a "major" node connected (a) through a first detector diode to the output of said first buffering circuit, (b) through a second detector diode, polarized the same as the first detector diode, to the output of said second buffering circuit, (c) through a first capacitor to common ground, and (d) through a first resistor to a "major" voltage divider node thence through a second resistor to common ground; whereby quasi-peak detection produces at the "major" node a d.c. "major" voltage, proportional to the amplitude of the stronger of the first buffered signal and the second buffered signal;

a second envelope detector circuit having a "sum" node connected (a) through a third detector diode to the output of the said summing circuit, (b) through a second detector capacitor, nominally identical with said first capacitor, to common ground, and (c) through a third resistor to a "sum" voltage divider node thence through a fourth resistor to common ground; whereby quasi-peak detection produces at the "sum" node a d.c. "sum" voltage, proportional to the amplitude of the sum signal;

a first comparitor device, of the integrated circuit operational amplifier type, having (a) an output connected so as to selectively energize one of the LEDs, (b) a first differential input connected to the "major" voltage divider node and (c) a second differential input connected to the "sum" node;

a second comparitor device, nominally identical with said first comparitor device, having (a) an output connected so as to selectively energize the other LED, (b) a first differential input connected to the "sum" voltage divider node, and (c) a second differential input connected to the "major" node;

whereby, from a comparison between said detected "major" voltage and said detected "sum" voltage, one of the LEDs is caused to become energized to provide an "in-phase" indication whenever the detected "sum" voltage exceeds the detected "major" voltage by a first margin, and conversely the other LED is caused to become energized to provide an "out-of-phase" indication whenever the detected "major" voltage exceeds the detected "sum" voltage by a second margin, said first and second margins being predetermined by voltage division ratios set by resistance values of the first, second, third and fourth resistors.

7. The phase polarity test instrument according to claim 6 further comprising, as a quiescent holdoff comparitor biasing circuit, a d.c. voltage source;

a fifth resistor connected between said voltage source and said "major" node; and a sixth resistor, nominally equal in resistance to said fifth resistor, connected between said voltage source and the "sum" node;

wherein resistance values of said fifth and sixth resistors and said d.c. voltage source are selected in design such that, whenever amplitudes of said first and second buffered signals are below a predetermined working threshold level, a reverse holdoff bias is applied to the differential inputs of said comparitor devices so as to hold them in an "off" mode and thus inhibit energization of the two LED phase polarity indicators.

8. The phase polarity test instrument according to claim 6 further comprising first signal indicator means adapted to provide a visual indication whenever the amplitude of said first buffered signal exceeds a predetermined threshold level, and second signal indicator means, identical with said first signal indicator means, adapted to provide a visual indication whenever the amplitude of said second buffered signal exceeds the predetermined threshold level.

9. The phase polarity test instrument according to claim 8 wherein said first and second signal indicator means are adapted to further provide quantitative visual indication of amplitude levels of said first and second buffered signals respectively in a range above the threshold level.

10. The phase polarity test instrument according to claim 9 further comprising third indicator means, identical with said first and second indicator means, adapted to provide quantitative visual indication of amplitude level of said sum signal in a range above the threshold level.

11. The phase polarity test instrument according to claim 8 wherein said first buffering circuit comprises a first amplifier and an associated input receptacle and said second buffering circuit comprises a second amplifier and an associated input receptacle, the receptacles being of a type suitable for coupling exteral input means such as microphones and shielded test probes.

12. The phase polarity test instrument according to claim 11 in which said first and second amplifiers each have an output of low impedance in the order of a few ohms, and said summing circuit comprises:

a third amplifier having a gain of two times, an output and a non-inverting input;

a first resistor, having a resistance value several orders of magnitude higher than said amplifier output impedance, connected between the output of said first amplifier and said non-inverting input; and a second rsistor, having a nominal resistance value equal that of said first resistor, connected between the output of said second amplifier and said non-inverting input;

whereby the instantaneous amplitude of said sum signal is caused to be substantially equal to the algebraic sum of the instantaneous amplitudes of said first and second buffered signals supplied at said first and second amplifier outputs.

13. The phase polarity test instrument according to claim 11 in which said first alternating signal comprises a first acoustic signal emanating from a first source such as a first loudspeaker, said second alternating signal comprises a second acoustic signal emanating from a second source such as a second loudspeaker, and said test instrument further comprises:

a first microphone, disposed so as to receive said first acoustic signal predominantly, coupled to an input of said first amplifier; and a second microphone, disposed so as to receive said second acoustic signal predominantly, coupled to an input of said second amplifier;

whereby said test instrument is enabled to indicate relative phase polarity between said first acoustic signal and said second acoustic signal.

14. A method for determining relative phase polarity between a first alternating signal and a second alternating signal, comprising the steps of:

(a) processing said alternating signals in a manner to preserve their relative phase polarity, to provide a first buffered electrical signal representing said first alternating signal and to provide a second buffered electrical signal representing said second alternating signal;

(b) deriving a sum signl having instantaneous amplitude equal to the algebraic sum of the instantaneous amplitudes of said first and second buffered signals;

(c) further processing and comparing said first buffer signal, said second buffered signal and said sum signal in indicating means adapted to provide an "in-phase" indication whenever said sum signal exceeds each of said buffered signals in amplitude by a predetermined margin, and to provide an "out-of-phase" indication, distinguishable from said "in-phase" indication, whenever either of said buffered signals exceeds said sum signal in amplitude by a predetermined margin.

15. The method for determining relative phase polarity between two alternating signals in accordance with claim 14, wherein said first alternating signal is a first acoustic signal emanating from a first source such as a first loudspeaker, said second alternating signal is a second acoustic signal emanating from a second source such as a second loudspeaker, and wherein step (a) comprises the subordinate steps of:

(a1) deploying a first microphone so as to receive said first acoustic signal predominantly and to deliver a resultant transduced electrical signal as input to first amplifier means adapted to thus provide said first buffered signal as output;

(a2) deploying a second microphone so as to receive said second acoustic signal predominantly and to deliver a resultant transduced electrical signal as input to second amplifier means adapted to thus provide said second buffered signal as output.

16. The method for determining relative phase polarity between two alternating signals in accordance with claim 14, wherein said first and second buffered signals are provided at low driving impedance in the order of a few ohms, and wherein step 8b) comprises the subordinate steps of:

(b1) applying said first buffered signal and said second buffered signal to opposite ends of a series branch comprising a first and second resistor connectd together at a common junction, said resistors having nominally equal resistance value several orders of magnitude greater than said driving impedance; and (b2) providing a third amplifier having a voltage gain of two times and having a non-inverting input connected to said junction, thus enabling said amplifier to provide said sum signal as output.

17. The method for determining relative phase polarity between a first alternating signal and a second alternating signal in accordance with claim 14, wherein step (c) comprises the subordinate steps of:

(c1) providing three identical level indicators, such as LED dot/bar graph displays arranged side by side, adapted to provide continuous simultaneous display of the relative amplitude levels of (1) said first buffered signal, (2) said sum signal and (3) said second buffered signal;

(c2) observing the relation between the sum level and the greater of the two buffered signal levels, as indicated; and (c3) determining relative phase polarity therefrom: "in-phase" being indicated whenever the sum level exceeds the greater of the two buffered signal levels, and "out-of-phase" being indicated whenever the greater of the two buffered signal levels exceeds the sum level.

18. The method for determining relative phase polarity between a first alternating signal and a second alternating signal in accordance with claim 14, wherein step (c) comprises the subordinate steps of:

(c1) envelope-detecting the two buffered signals in first detector means adapted to provide a detected "major" d.c. voltage proportional to the amplitude of the greater of the two buffered signals;

(c2) envelope-detecting the sum signal in second detector means dynamically matched with the first detector means, so as to thus provide a detected "sum" d.c. voltage proportional to the amplitude of the sum signal; and (c3) comparing the "major" voltage with "sum" voltage in an electronic comparitor circuit adapted to indicate "in-phase" on a first visual indicator such as an LED whenever the "sum" voltage exceeds the "major" voltage, and to indicate "out-of-phase" on a second visual indicator whenever the "major" voltage exceeds the "sum" voltage.

19. The method for determining relative phase polarity between a first alternating signal and a second alternating signal in accordance with claim 18, wherein step (c3) comprises the subordinate steps of:

(c3a) applying the "major" voltage to a "major" voltage divider branch comprising a first resistor connected at a junction to a second resistor returned to common ground;

(c3b) applying the "sum" voltage to a "sum" voltage divider branch comprising a third resistor connected at a junction to a fourth resistor returned to common ground;

(c3c) providing a first LED indicator, selectively energizable from a first differential comparitor circuit having a first input connected to the "major" voltage divider junction and a second input receiving the "sum" voltage, so as to energize the first LED indicator and thus provide an "out-of-phase" indication whenever the "major" voltage exceeds the "sum" voltage by an amount predetermined mainly by voltage division ratio of the "major" voltage divider, and (c3d) providing a second LED indicator, selectively energizable from a second differential comparitor circuit having a first input receiving the "major" voltage and a second input connected to the "sum" voltage divider junction so as to energize the second LED indicator and thus provide an "in-phase" indication whenever the "sum" voltage exceeds the "major" voltage by an amount predetermined by voltage division ratio of the "sum" voltage divider; and (c3e) applying a quiescent holdoff bias from a d.c. voltage source through a fifth resistor to the "major" voltage divider branch and through a sixth resistor, nominally identical to the fifth resistor, to the "sum" divider branch so as to inhibit energization of the two LED indicators in the absence of input signals of sufficient working level.

* * * * *

UNITED STATES PATENT AND TRADEMARK OFFICE

CERTIFICATE OF CORRECTION

PATENT NO. : 4,908,868

DATED : Mar. 13, 1990

INVENTOR(S) : James E. McTaggart

It is certified that error appears in the above-identified patent and that said Letters Patent is hereby corrected as shown below:

Column 1, line 44, "originatin" should be --originating--

Column 2, line 6, "misundestood" should be --misunderstood--

Column 2, line 39, "correcct" should be --correct--

Column 4, line 13, "ha" should be --has--

Column 4, line 31, "priary" should be --primary--

Column 5, line 36, "taper" should be --tape--

Column 7, line 6, "catodes" should be --cathodes--

Column 7, line 51, "develped" should be --developed--

Column 8, line 12, "VA" should be --Va--

Column 11, line 63, "instill" should be --in still--

Column 14, line 53, "rsistor" should be --resistor--

Columns 13 and 14 are erroneously line-spaced relative to each other and relative to the line numbers, rendering line identification highly ambiguous, for example at Column 13, lines 20-35 and at Column 14, lines 5-15 and 45-55.

Signed and Sealed this

Thirtieth Day of April, 1991

*Attest:*

*Attesting Officer*

HARRY F. MANBECK, JR.

*Commissioner of Patents and Trademarks*